United States Patent [19]

Tange et al.

[11] 4,136,490

[45] Jan. 30, 1979

[54] APPARATUS FOR PREVENTING CIRCUMFERENTIAL OVERSPEEDING OF A GRINDING WHEEL

[75] Inventors: Shinji Tange, Aichi; Akihiro Matsuura, Kariya, both of Japan

[73] Assignee: Toyoda-Koki Kabushiki-Kaisha, Kariya, Japan

[21] Appl. No.: 855,614

[22] Filed: Nov. 29, 1977

[30] Foreign Application Priority Data

Nov. 30, 1976 [JP] Japan ..... 51-144518

[51] Int. Cl.[2] ..... B24B 55/00

[52] U.S. Cl. ..... 51/134.5 R

[58] Field of Search ..... 51/134.5 R, 134.5 F, 51/165 R

[56] References Cited

U.S. PATENT DOCUMENTS

| | | | |
|---|---|---|---|
| 3,656,262 | 4/1972 | Kikuchi | 51/134.5 R |
| 3,673,741 | 7/1972 | Koide | 51/134.5 R |
| 4,090,331 | 5/1978 | Kobayashi | 51/134.5 R |

FOREIGN PATENT DOCUMENTS

| | | | |
|---|---|---|---|
| 1029966 | 6/1953 | France | 51/134.5 R |
| 48-10329 | 1973 | Japan | 51/134.5 |
| 48-45184 | 1973 | Japan | 51/134.5 |

*Primary Examiner*—Harold D. Whitehead

*Attorney, Agent, or Firm*—Oblon, Fisher, Spivak, McClelland & Maier

[57] ABSTRACT

An apparatus for preventing circumferential overspeeding of a grinding wheel is provided in which first and second rejection members, pivotably carried respectively on a motor base and a wheel head, are connected with each other through a transmitting mechanism. The mechanism is arranged to prevent, by the first rejection member, the attachment of a large diameter pulley to a motor on the motor base when a grinding wheel with a maximum useable diameter, or one having a diameter greater than a predetermined pulley exchange diameter, is on a wheel spindle of a wheel head, without interference with the second rejection member. A parallel motion mechanism is incorporated in the transmitting mechanism so that the same may transmit pivotal movement of the first rejection member to the second rejection member without being affected by movement of the motor base on the wheel head.

6 Claims, 3 Drawing Figures

APPARATUS FOR PREVENTING CIRCUMFERENTIAL OVERSPEEDING OF A GRINDING WHEEL

BACKGROUND OF THE INVENTION

1. Field of the Invention

The present invention relates to an apparatus for preventing a grinding wheel from rotating at an excessive circumferential speed, more than a predetermined speed, due to an improper selective use of motor pulleys.

2. Description of the Prior Art

In a grinding technology, generally a motor pulley on a motor shaft is exchanged with a reserved motor pulley larger in diameter than the first mentioned motor pulley, thereby to recover a circumferential speed of a grinding wheel when the same wears by a predetermined amount. However, unless the reserved motor pulley is exchanged with the previously used pulley having a small diameter when the grinding wheel wears beyond a useable or tolerable range to be replaced by a fresh grinding wheel, this fresh wheel is rotated at an excessive speed, more than a predetermined speed, and gets into danger of destruction.

In order to avoid such danger, there have been developed wheel circumferential overspeeding preventing apparatus of the kind that only a small diameter motor pulley is attachable on an electric motor while a large diameter grinding wheel is being mounted on a wheel spindle of a wheel head, and such apparatus provides on the wheel head both a rejection member for detecting the diameter of the grinding wheel and another rejection member for restraining a large pulley from attachment while the diameter of the grinding wheel is large.

Because of such construction, the distance between the motor pulley and the rejection member opposing the same must be further extended when, for the purpose of tension adjustment or compensation for belt stretch, the position of the motor base is adjusted to be further distanced from the grinding wheel so as to thereby lengthen the distance between the motor pulley and the wheel spindle. Consequently, although the grinding wheel is not yet reduced to a diameter for pulley exchange, a large diameter pulley is put in a condition to be attachable to the motor shaft, so that the grinding wheel may be in danger of being rotated at an excessive circumferential speed.

In the case where the support position of the other rejection member is decided, taking belt stretch into consideration, the foregoing drawback can be solved. In this case, however, while the belts remain almost fresh or unstretched, an exchange of the motor pulley to the large one is impossible, even when the grinding wheel becomes small beyond a predetermined diameter to decrease the circumferential speed of the grinding wheel below a tolerable speed, and, therefore, there is raised another drawback that the wheel circumferential speed cannot be maintained within a tolerable range.

SUMMARY OF THE INVENTION

Accordingly, it is an object of the present invention to provide an improved apparatus for preventing circumferential overspeeding of a grinding wheel which is simple in construction and is reliable in operation.

Another object of the invention is to provide an improved apparatus of the character set forth above which allows free positional adjustment of a motor base mounting a wheel drive motor.

Another object of the invention is to provide an improved apparatus of the character set forth above which, as long as a large diameter pulley is on a wheel drive motor, can reliably prevent a grinding wheel with a maximum useable diameter from being mounted on a wheel spindle even when a motor base mounting the motor is moved to any position within an adjustable range.

Briefly, according to this invention, there is provided an apparatus for preventing circumferential overspeeding of a grinding wheel in a grinding machine having a wheel head rotatably carrying a wheel spindle for supporting the grinding wheel, a motor base slidably mounted upon the head for movement in a direction transverse to the wheel spindle, a motor fixed upon the motor base for rotating the wheel spindle through a belt, and large and small diameter pulleys alternatively attachable to a motor shaft of the motor, the apparatus comprising a first link protruding a first rejection member and pivotally carried on the motor base to move the rejection member to and away from one of the pulleys on the motor shaft, a second link protruding a second rejection member and pivotably carried on the wheel head to move the second rejection member to and away from the grinding wheel, transmitting means for transmitting pivotal movement of the first link to the second link, and a parallel motion mechanism incorporated in the transmitting means.

The transmitting means is arranged to prevent, by the first rejection member, the attachment of the large diameter pulley to the motor shaft when a grinding wheel with a maximum useable diameter, or a diameter greater than a predetermined pulley exchange diameter, is on the wheel spindle, without interference with the second rejection member. The parallel motion mechanism causes the transmitting means to operate without being affected by movement of the motor base, whereby a simultaneous use of the large diameter pulley and the wheel having the maximum diameter can be absolutely prevented.

BRIEF DESCRIPTION OF THE DRAWINGS

Various other objects, features and attendant advantages of the present invention will be readily appreciated as the same becomes better understood from the following detailed description of a preferred embodiment when considered in connection with the accompanying drawings, wherein like reference numerals designate like or corresponding parts throughout the several views, and in which.

DETAILED DESCRIPTION OF A PREFERRED EMBODIMENT

Figure 1:
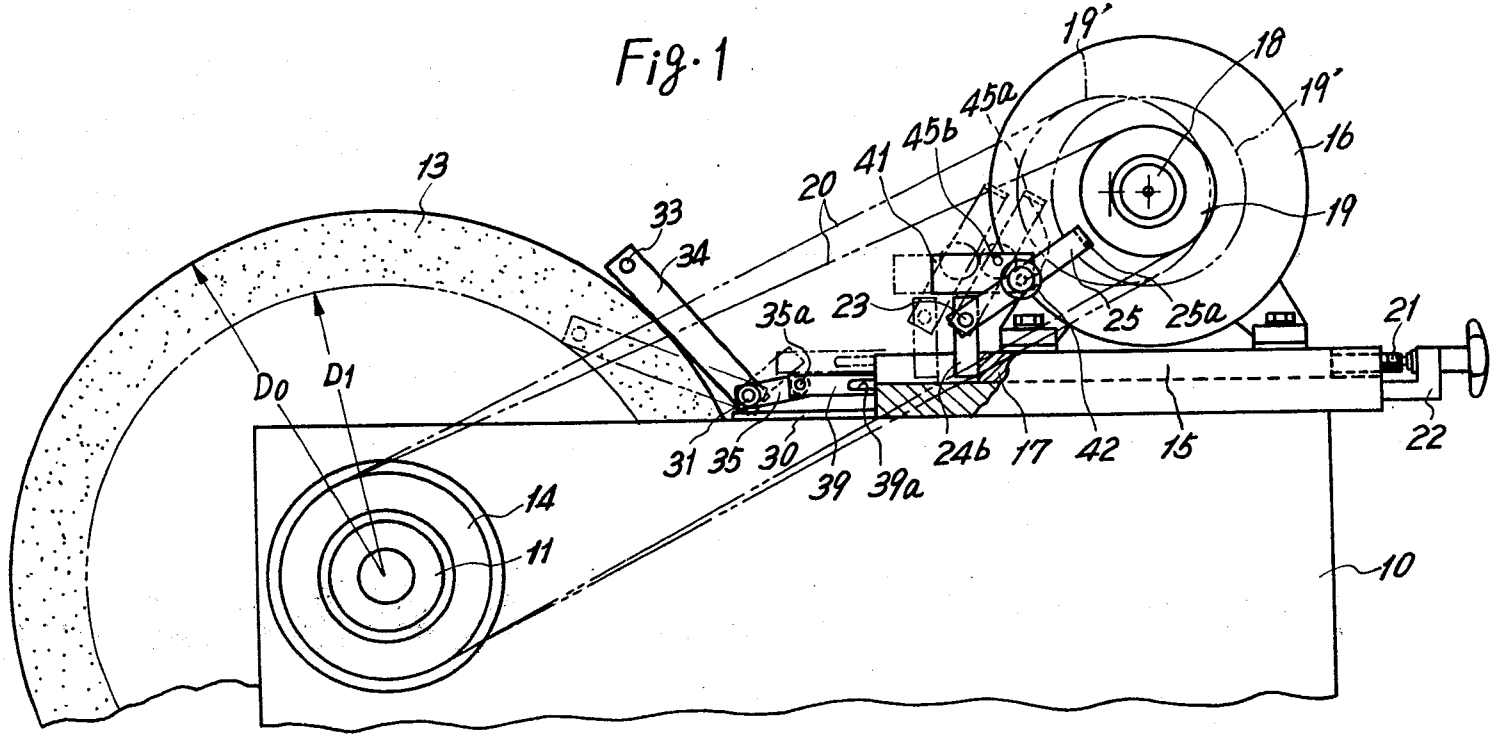
FIG. 1 is a side elevational view, partly in section, of a wheel head of grinding machine on which an apparatus according to the present invention is mounted.

Referring now to the drawings, a bed, not shown, of a grinding machine has mounted thereon a wheel head 10, on which a wheel spindle 11 is rotatably carried. A grinding wheel 13 is fixedly mounted, through a wheel sleeve assembly 12, on one end of the wheel spindle 11, to the other end of which a spindle pulley 14 is attached.

On the rear end of the wheel head 10, a guide base 15 is fixed, by which a motor base 17, mounting thereon a wheel drive motor 16, is guided for movement in a direction transverse to the axis of the wheel spindle 11. One or more belts 20 are wound, with a tension force, round the spindle pulley 14 and a small diameter motor pulley 19 is attached to a motor shaft 18 of the motor 16, with this motor shaft 18 being in driving connection with the grinding wheel 13. An adjusting screw 21 is threadedly engaged with the motor base 17 and is restrained from axial movement by a support 22 secured to the wheel head 10. It is therefore noted that compensation for stretch of the belts 20 or tension adjustment can be effected by rotating the adjusting screw 21 to displace the motor base 17.

Figure 2:
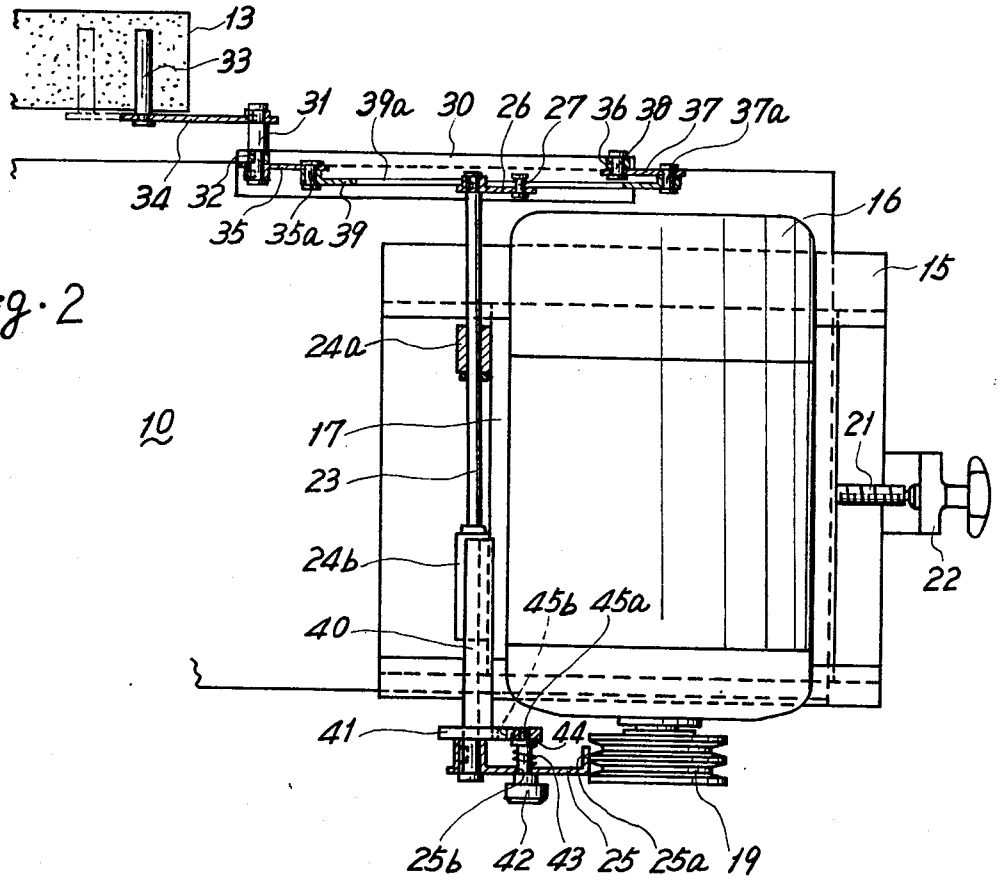
FIG. 2 is a plan view of an important portion of the apparatus shown in FIG. 1.
Figure 3:
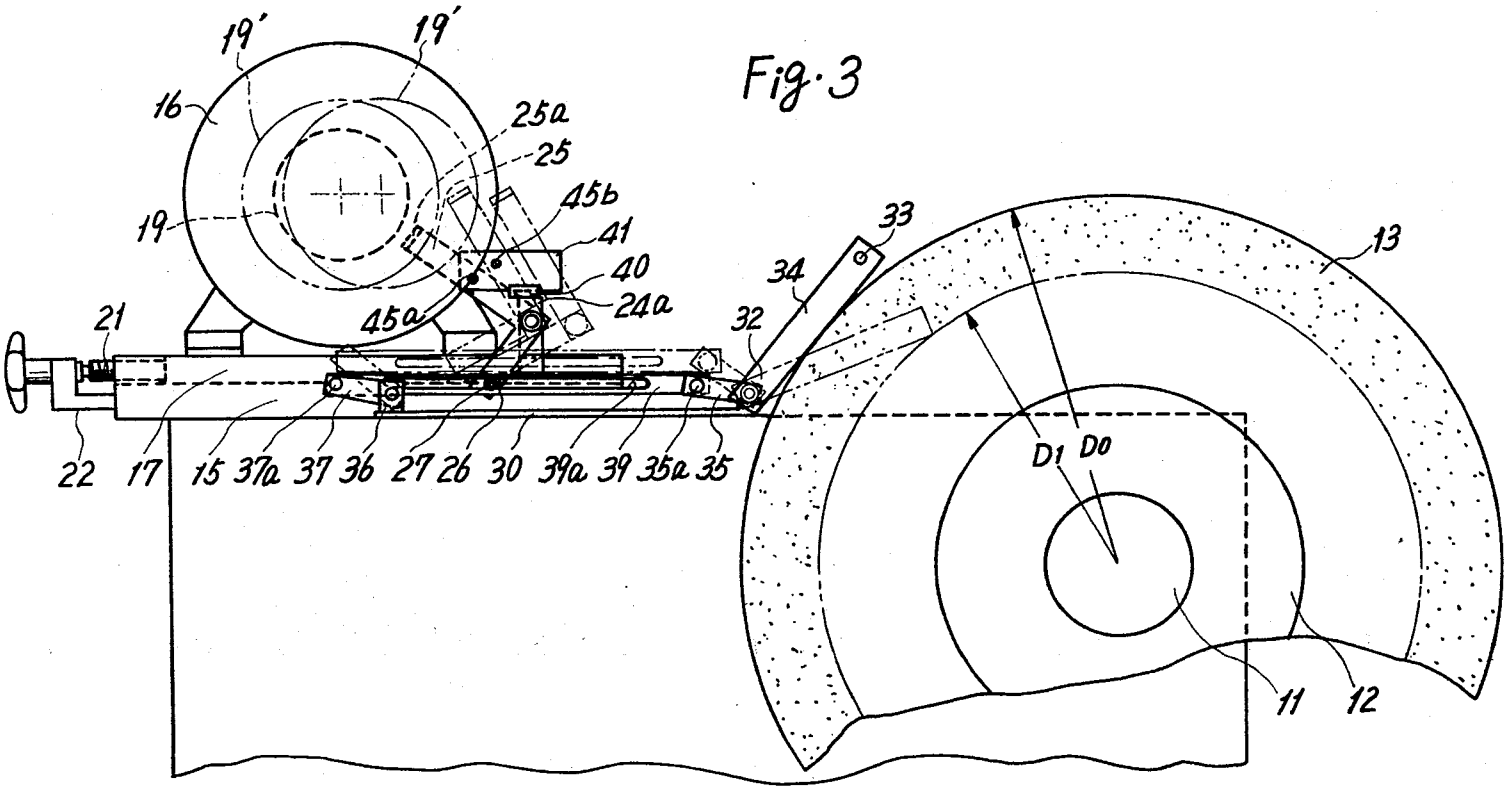
FIG. 3 is another side elevational view of the apparatus, viewed from the opposite direction.

On the motor base 17, as best shown in FIG. 2, a first connecting shaft 23 is rotatably supported by means of support members 24*a* and 24*b* in parallel relation with the axis of the wheel spindle 11. A first connecting link 25, having a first rejection portion or member 25*a* protruding or extending from its one end, is keyed on one end near the motor pulley 19 of the connecting shaft 23 so as to oppose and move the rejection member 25*a* to and away from the circumferential surface of the motor pulley 19. Another connecting link 26, constituting the transmitting means, together with the connecting shaft 23, is keyed on the other end of the same and is provided with a guided member or pin 27, which is guided by an elongate slot 39*a* of an elongate link 39. A parallel motion mechanism, not numbered, includes this link element 39 and is incorporated in the transmitting means.

The wheel head 10 has fixed thereon a stationary plate 30 on which a second connecting shaft 31 is rotatably carried by means of a holding plate 32, in parallel relation with the axis of the wheel spindle 11. A second connecting link 34 is keyed on one end at the wheel side of the connecting shaft 31 and is provided at its free end with a second rejection member 33 opposing to and being moved toward and away from the grinding wheel 13. A floating link 35 is keyed on the other end of the connecting shaft 31 and is pivotable together with the connecting link 34.

On one end, near the motor 16, of the stationary plate 30, there is fixed a support plate 36, by which a floating link 37 of the same length as the aforementioned floating link 35 is rotatably hinged through a pin 38. The elongate link 39 is interconnected between the floating links 35 and 37 and is pivotably hinged on the free ends of the same through pins 35*a* and 37*a*. It is therefore understood that pivotal movement of the connecting link 34 causes the elongate link 39 to move up and down in a vertical plane parallel with movement of the motor base 17. As mentioned previously, the elongate link 39 is formed with an elongate slot 39*a* extending to the movement of the motor base 17, and the guided pin 27 of the connecting link 26 is received within the elongate slot 39*a*. With this configuration, vertical movement of the elongate link 39 is converted, by means of the elongate slot 39*a* and the guided pin 27, to pivotal movement of the connecting link 26, without being affected by movement of the motor base 17, and this pivotal movement of the connecting link 26 is transmitted to the first rejection member 25*a* through the connecting shaft 23 and the connecting link 25.

A locating plate 41 is secured through a connecting plate 40 to the support member 24*b* fixed on the motor base 17. The connecting link 25 has formed therein, near the mid position in its length, a hole 25*b*, by which a manipulation knob 42 is held, being pulled by means of a spring 43 toward the locating plate 41 in a direction parallel with the connecting shaft 23. A locating pin 44, provided at one end of the manipulation knob 42, is engageable selectively with one of two locating holes 45*a* and 45*b* formed on the locating plate 41. In the condition where the locating pin 44 is being inserted into the locating hole 45*a*, the second and first rejection members 33, 25*a* allow mounting of a grinding wheel 13 with a maximum useable diameter Do and of the small diameter motor pulley 19. Only when the diameter of the grinding wheel 13 becomes smaller than a pulley exchange diameter $D_1$, thus needing an increase of rotational speed, does it become possible to insert the locating pin 44 into the locating hole 45*b*, and in the condition where the locating pin 44 is inserted into the locating hole 45*b*, attachment of the large diameter motor pulley 19' is then allowed.

The operation of the embodiment, as constructed above, will hereinbelow be described. When the diameter of the grinding wheel 13 is larger than the pulley exchange diameter $D_1$, the locating pin 44 is inserted into the locating hole 45*a*, and the first rejection member 25*a* is thus being held at such a position as indicated by the solid line in FIG. 1. By this, the small diameter pulley 19 is attached to the motor shaft 18, while the large diameter pulley 19' is being prevented from such attachment. In this situation, furthermore, even when the motor base 17 is moved in the opposite direction of the wheel spindle 11 for the purpose of tension adjustment or compensation for stretching of the belts 20, the position of the first rejection member 25*a* relative to the small diameter pulley 19 of the motor shaft 18 remains unchanged, since the guided pin 27 is moved along the elongate slot 39*a* together with and in parallel relation with the motor base 17. Accordingly, the possibility of attachment of the large diameter pulley due to movement of the motor base 17 accompanied by the compensation for stretching of the belts 20 can be prevented, so long as the diameter of the grinding wheel 13 is not smaller than $D_1$ and the grinding wheel 13 is thus prevented from being rotated at an excessive circumferential speed.

When the diameter of the grinding wheel 13 becomes smaller than $D_1$ as a result of performance of grinding and dressing operations, the locating pin 44 becomes insertable into the locating hole 45*b*. As the locating pin 44 is inserted into this locating hole 45*b* by manipulating the knob 42, the first rejection member 25*a* is positioned at such a position as indicated by the dotted line in FIG. 1. Consequently, attachment of the large diameter pulley 19', for the first time, becomes possible. Following moving the motor base 17 toward the wheel spindle 11, the large diameter pulley 19' is attached, so that the rotational speed of the grinding wheel 13 may be increased to recover the circumferential speed of the wheel 13 within a desired or tolerable range.

When the diameter of the grinding wheel 13 is reduced to its minimum useable diameter, it becomes necessary to exchange the wheel 13 with a new or fresh grinding wheel 13 having a useable maximum diameter Do. For this purpose, the knob 42 is manipulated to insert the locating pin 44 into the locating hole 45*a*, and the first rejection member 25*a* is positioned again at such a position as indicated by the solid line. In this situation, only the small diameter pulley 19 can be attached, while the large diameter pulley 19' cannot be attached, since it interferes with the first rejection member 25*a*. Accordingly, rotation of a grinding wheel 13 having a diameter greater than $D_1$, using the large diameter pulley 19' is prevented, so that the grinding wheel 13 is out of danger being rotated at an excessive circmferential speed.

In a circumferential overspeeding preventing apparatus according to the present invention, as mentioned previously, the first connecting link protruding the first rejection member to be abuttable with the motor pulley is pivotably hinged upon a motor base, the second connecting link protruding the second rejection member to be abuttable with the grinding wheel is pivotably hinged upon the wheel head, and pivotal movements of the first and second connecting links are transmitted therebetween through the parallel motion mechanism, whose motion is not affected by the movement of the motor base. Accordingly, even when the motor base is moved for the purpose of compensating for stretching of the belts or of tension adjustment, no change in the distance between the first rejection member and the motor pulley is brought about and thus the large diameter motor pulley can be prevented from being attached through mistake due to the movement of the motor base, so that the grinding wheel is out of danger of being rotated at an excessive circumferential speed.

Obviously, numerous modifications and variations of the present invention are possible in light of the above teachings. It is therefore to be understood what within the scope of the appended claims, the invention may be practiced otherwise than as specifically described herein.

What is claimed as new and desired to be secured by Letters Patent of the United States is:

1. An apparatus for preventing circumferential overspeeding of a grinding wheel in a grinding machine having a wheel head rotatably carrying a wheel spindle for supporting said grinding wheel, a motor base slidably mounted upon said wheel head for movement in a direction transverse to the axis of said wheel spindle, a motor fixed on said motor base for rotating said wheel spindle through a belt, and large and small diameter motor pulleys alternatively attachable to a motor shaft of said motor, the apparatus comprising:

a first link having a first rejection member protruding therefrom, said first link being pivotably carried on said motor base to move said first rejection member to and away from one of said motor pulleys on said motor shaft;

a second link having a second rejection member protruding therefrom, said second link being pivotably carried on said wheel head to move said second rejection member to and away from said grinding wheel;

transmitting means for transmitting pivotal movement of said first link to said second link so as to prevent, by said first rejection member, an attachment of said large diameter pulley to said motor shaft when a grinding wheel having a diameter greater than a predetermined pulley exchange diameter is on said wheel spindle without interference with said second rejection member; and a parallel motion mechanism incorporated in said transmitting means for causing the same to operate without being affected by movement of said motor base.

2. An apparatus as claimed in claim 1, wherein said parallel motion mechanism includes one link element extended in a direction parallel with the movement of said motor base and formed with an elongate slot, and wherein said transmitting means comprises a guided member guided along said elongate slot and pivotable together with said first link.

3. An apparatus as claimed in claim 2, wherein said transmitting means further comprises:

a connecting shaft rotatably supported on said motor base in parallel relation with said wheel spindle and fixedly carrying said first link; and a third link fixedly carried on said connecting shaft and having said guided member which is guided along said elongate slot protruding therefrom.

4. An apparatus as claimed in claim 3, wherein said parallel motion mechanism is provided on said wheel head near said grinding wheel in a side-by-side relation with said motor base, and wherein said connecting shaft is extended to allow said guided member to be guided along said elongate slot.

5. An apparatus as claimed in claim 3, further comprising locating means for positioning said first link selectively at such a first angular position as to move said first rejection member into abutting engagement with said large diameter motor pulley and at such a second angular position as to release said first rejection member from said abutting engagement.

6. An apparatus as claimed in claim 5, wherein said locating means comprises:

a locating pin carried on said first link for movement in a direction parallel with said connecting shaft;

a locating plate fixedly mounted on said motor base and formed with two pin holes capable of receiving said locating pin so as to position said first rejection member selectively at said first and second angular positions; and a spring interposed between said first link and said locating pin so as to urge the same to be received in said pin holes.

* * * * *